US008204415B2

(12) United States Patent
Nakagawa et al.

(10) Patent No.: US 8,204,415 B2
(45) Date of Patent: Jun. 19, 2012

(54) DEVELOPING UNIT, PROCESSING UNIT, AND IMAGE FORMING APPARATUS

(75) Inventors: Yoshinori Nakagawa, Kanagawa (JP); Yasuyuki Ishii, Tokyo (JP); Hideki Kosugi, Kanagawa (JP); Tomoko Takahashi, Kanagawa (JP); Masaaki Yamada, Tokyo (JP); Masanori Saitoh, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 513 days.

(21) Appl. No.: 12/418,022

(22) Filed: Apr. 3, 2009

(65) Prior Publication Data

US 2009/0257791 A1 Oct. 15, 2009

(30) Foreign Application Priority Data

Apr. 10, 2008 (JP) ..... 2008-102030

(51) Int. Cl.
*G03G 15/08* (2006.01)

(52) U.S. Cl. ..... 399/281; 399/258; 399/267; 399/282; 399/287

(58) Field of Classification Search ..... 399/267, 399/281, 282, 287
See application file for complete search history.

(56) References Cited

U.S. PATENT DOCUMENTS

| | | | | |
|---|---|---|---|---|
| 5,099,271 | A * | 3/1992 | Maeda et al. | 399/287 |
| 5,365,318 | A * | 11/1994 | Hiraoka et al. | 399/44 |
| 6,321,057 | B1 * | 11/2001 | Yamamoto | 399/281 |
| 6,381,434 | B1 * | 4/2002 | Yamamoto | 399/266 |
| 6,721,534 | B2 | 4/2004 | Takahashi | |
| 7,308,222 | B2 | 12/2007 | Nakagawa et al. | |
| 7,412,190 | B2 | 8/2008 | Kadota et al. | |
| 7,725,056 | B2 * | 5/2010 | Kosugi et al. | 399/222 |
| 2006/0216071 | A1 | 9/2006 | Yamada et al. | |
| 2006/0251449 | A1 | 11/2006 | Takahashi et al. | |
| 2007/0013924 | A1 | 1/2007 | Sakai et al. | |
| 2007/0015071 | A1 | 1/2007 | Tsukamoto et al. | |
| 2007/0160395 | A1 | 7/2007 | Kosugi et al. | |
| 2007/0212121 | A1 | 9/2007 | Takahashi et al. | |
| 2007/0242985 | A1 | 10/2007 | Aoki et al. | |
| 2008/0089720 | A1 | 4/2008 | Tsukamoto et al. | |
| 2008/0089723 | A1 * | 4/2008 | Tsukamoto et al. | 399/281 |
| 2008/0124138 | A1 | 5/2008 | Kosugi et al. | |
| 2008/0286015 | A1 | 11/2008 | Kadota et al. | |
| 2009/0016781 | A1 | 1/2009 | Takahashi et al. | |
| 2009/0022523 | A1 | 1/2009 | Kadota et al. | |
| 2009/0035025 | A1 | 2/2009 | Ishii et al. | |
| 2009/0067889 | A1 | 3/2009 | Nakagawa et al. | |
| 2009/0074431 | A1 | 3/2009 | Aoki et al. | |
| 2009/0257791 | A1 * | 10/2009 | Nakagawa et al. | 399/287 |

FOREIGN PATENT DOCUMENTS

| | | | |
|---|---|---|---|
| JP | 61052663 | A * | 3/1986 |
| JP | 1-31611 | | 6/1989 |
| JP | 4-46428 | | 2/1992 |
| JP | 04362675 | A * | 12/1992 |
| JP | 2004-198675 | | 7/2004 |
| JP | 2007-133389 | | 5/2007 |

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A developing unit includes a brush member that includes a base member and a plurality of raisings that are erected on a surface of the base. The brush member traps toner within the raisings and causes a flicker movement in the raisings of the brush so that the toner trapped within the raisings is shaken and flown due to the flicker movement to the surface of a toner carrying member.

14 Claims, 8 Drawing Sheets

DEVELOPING UNIT, PROCESSING UNIT, AND IMAGE FORMING APPARATUS

CROSS-REFERENCE TO RELATED APPLICATIONS

The present application claims priority to and incorporates by reference the entire contents of Japanese priority document 2008-102030 filed in Japan on Apr. 10, 2008.

BACKGROUND OF THE INVENTION

1. Field of the Invention

The present invention relates to a developing unit that develops a latent image on a latent-image carrying member with toner, a processing unit, and an image forming apparatus.

2. Description of the Related Art

A conventional developing unit has been disclosed in Japanese Patent Application Laid-open No. 2007-133389. The developing unit includes a cylindrical toner carrying member that is rotatably held on a rotation axis.

Elongated electrodes, which extend in a linear direction of the rotation axis, are arranged on the toner carrying member at a predetermined pitch. An alternating electric field is formed between the mutually adjacent electrodes on a surface of the toner carrying member. Directions of the alternating electric field are changed such that toner hops from the top of one of the electrodes and lands onto an adjacent electrode. As a result of repeatedly hopping between adjacent electrodes, the toner is transported from one place to another place on the toner carrying member, along with rotations of the toner carrying member, and finally reaches a developing area opposite a latent-image carrying member. In the developing area, the toner, which hops from the surface of the toner carrying member and flies up to the vicinity of the latent-image carrying member, is pulled by the electric field due to a latent image and adheres to the latent image. Due to this, the latent image develops into a toner image.

In another known developing unit, the toner is transported to the developing area using a movement due to hopping instead of being transported to the developing area due to a surface movement of a toner carrying member itself. For example, a developing unit disclosed in Japanese Patent Application Laid-open No. 2004-198675 uses a toner carrying member in which three types of electrodes called A-phase electrodes, B-phase electrodes, and C-phase electrodes are repeatedly arranged in a sequence. The toner sequentially hops from the A-phase electrodes onto the B-phase electrodes, from the B-phase electrodes onto the C-phase electrodes, and from the C-phase electrodes onto the A-phase electrodes on the surface of the toner carrying member. Thus, the toner is transported towards the developing area without the toner carrying member actually rotating.

The method of hopping toner enables to realize low potential developing that cannot be realized in an existing monocomponent developing method or a bicomponent developing method. For example, the toner can be caused to selectively adhere to an electrostatic latent image where an electric potential difference between the electrostatic latent image and the surrounding non-image portion is only several tens of volts (V).

Various methods are used for supplying toner on the surface of a toner carrying member. For example, in the developing unit disclosed in Japanese Patent Application Laid-open No. 2007-133389, the toner inside a toner housing unit is transported towards a roller member due to rotatable driving of an agitator. The roller member rotates while touching a blade member. The roller member carries the toner, on the surface of the roller member itself and causes, along with self-rotation, the toner to enter a touching portion of the roller member and the blade member. The toner, which enters the touching portion, is strongly rubbed against the blade member and is friction-charged. Upon passing the touching portion along with the rotations of the roller member, the toner moves up to the vicinity of the surface of the toner carrying member and gets transferred onto the toner carrying member. Thus, the toner is supplied from the roller member to the toner carrying member.

In the developing unit disclosed in Japanese Patent Application Laid-open No. 2004-198675, a bicomponent developer, which contains toner and magnetic carrier, is caused to stick to a surface of a rotating magnet sleeve and transported up to the vicinity of the toner carrying member along with rotations of the magnet sleeve. Next, the electric potential difference between the magnet sleeve and the toner carrying member is used to transfer the toner in the bicomponent developer, which is carried on the magnet sleeve, onto the surface of the toner carrying member. Thus, the developing unit uses the bicomponent developer to supply the toner to the toner carrying member.

In developing units disclosed in Japanese Patent Publication No. H1-31611 and Japanese Patent Publication No. H4-46428, a portion of a circumferential surface of a cylindrical toner carrying member is immersed into the toner inside the toner housing unit. The toner carrying member is rotated in this state and the toner inside the toner housing unit is scooped up by the surface of the toner carrying member.

However, in the conventional technique, excessive stress is imparted on the toner. Specifically, upon carrying out various experiments using a prototype of a developing unit that uses the hopping method, the inventors discovered that hopping of the toner on the surface of the toner carrying member sufficiently friction-charges the toner. Even if the toner is not suitably charged in advance, the toner is sufficiently friction-charged due to repeated collision with the surface of the toner carrying member during the hopping until the toner is transported to the developing area. However, the developing unit disclosed in Japanese Patent Application Laid-open No. 2007-133389 charges the toner before supplying the toner to the toner carrying member. Due to this, the toner is strongly rubbed against the blade member on the rotating roller member. Such rubbing imparts unnecessary stress on the toner.

In the developing unit that is disclosed in Japanese Patent Application Laid-open No. 2004-198675 and that uses the bicomponent developer to supply the toner to the toner carrying member, generally the toner is replenished into the bicomponent developer when required and mixed by stirring. The replenished toner is slidingly rubbed with the magnetic carrier at the time of getting mixed by stirring and is friction-charged. Thus, in a structure that uses the bicomponent developer, before being supplied to the toner carrying member, the toner is inevitably slidably rubbed with the magnetic carrier in the bicomponent developer and is friction-charged. Such slidable rubbing imparts unnecessary stress on the toner.

In the developing units disclosed in Japanese Patent Publication No. H1-31611 and Japanese Patent Publication No. H4-46428, in a touching area of the toner inside the toner housing unit and the toner carrying member having the circumferential surface partially immersed into the toner, the toner is subjected to friction at the surface of the rotating toner carrying member. Such friction imparts unnecessary stress on the toner.

In the developing unit that uses the hopping method, the toner can also be supplied to the toner carrying member by using a method that is widely used in a general monocomponent developing unit. Specifically, a rotatable toner supplying member such as a sponge roller is caused to rotate while touching the toner carrying member and the toner on the toner supplying member is transferred onto the surface of the toner carrying member at a touching portion. However, in the method mentioned earlier, the toner is subjected to friction at the touching portion of the rotating toner supplying member and the toner carrying member. Such friction imparts unnecessary stress on the toner.

SUMMARY OF THE INVENTION

It is an object of the present invention to at least partially solve the problems in the conventional technology.

According to an aspect of the present invention, there is provided a developing unit that transports toner for supplying the toner onto a surface of a toner carrying member by a toner supplying unit, while causing the toner to hop on the surface using an electric field, to a developing area that is an area opposite the toner carrying member and a latent-image carrying member, causes the hopped toner to adhere to a latent image on the latent-image carrying member in the developing area, and develops the latent image. The developing unit includes a brush member that includes a base member and a plurality of raisings that are erected on a surface of the base, wherein the brush member traps toner within the raisings and causes a flicker movement in the raisings of the brush so that the toner trapped within the raisings is shaken and flown due to the flicker movement to the surface of the toner carrying member.

According to another aspect of the present invention, there is provided a processing unit that is used in an image forming apparatus that includes a latent-image carrying member that carries a latent image, a charger that charges the latent-image carrying member, a developing unit that develops the latent image on the latent-image carrying member, a transferring unit that transfers a toner image, obtained due to developing, from a surface of the latent-image carrying member to a transfer member, and a cleaning unit that cleans transfer residual toner that is adhering to the surface of the latent-image carrying member after a transferring process. At least one of the latent-image carrying member, the charger, and the cleaning unit is housed, along with the developing unit, in a common housing as a single unit and can be integrally attached to or detached from a main body of the image forming apparatus. The developing unit transports toner for supplying the toner onto a surface of a toner carrying member by a toner supplying unit, while causing the toner to hop on the surface using an electric field, to a developing area that is an area opposite the toner carrying member and the latent-image carrying member, causes the hopped toner to adhere to a latent image on the latent-image carrying member in the developing area, and develops the latent image. The developing unit includes a brush member that includes a base member and a plurality of raisings that are erected on a surface of the base, wherein the brush member traps toner within the raisings and causes a flicker movement in the raisings of the brush so that the toner trapped within the raisings is shaken and flown due to the flicker movement to the surface of the toner carrying member.

According to still another aspect of the present invention, there is provided an image forming apparatus including a latent-image carrying member that carries a latent image and a developing unit. The developing unit transports toner for supplying the toner onto a surface of a toner carrying member by a toner supplying unit, while causing the toner to hop on the surface using an electric field, to a developing area that is an area opposite the toner carrying member and the latent-image carrying member, causes the hopped toner to adhere to a latent image on the latent-image carrying member in the developing area, and develops the latent image. The developing unit includes a brush member that includes a base member and a plurality of raisings that are erected on a surface of the base, wherein the brush member traps toner within the raisings and causes a flicker movement in the raisings of the brush so that the toner trapped within the raisings is shaken and flown due to the flicker movement to the surface of the toner carrying member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are explained next with reference to the accompanying drawings.

Figure 1:
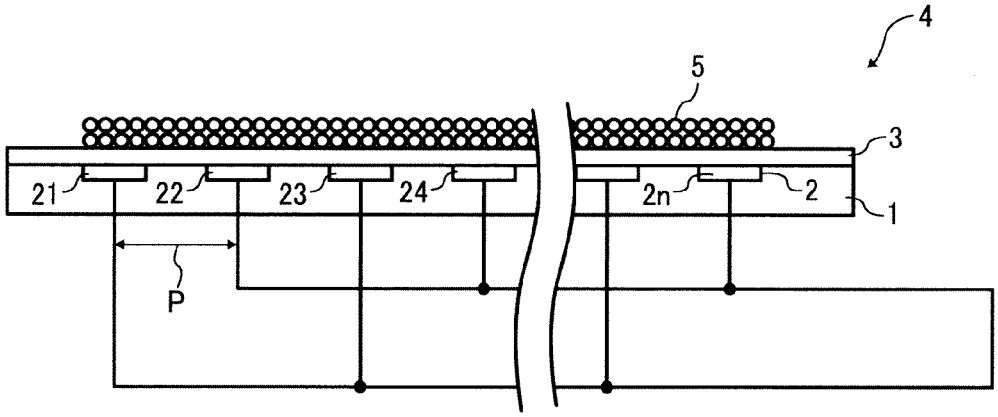
FIG. 1 is a schematic diagram of a substrate of an experimental device that is used by the inventors of the present invention.

An experiment, which is carried out by the inventors of the present invention on a developing unit that uses a hopping method, is explained first. FIG. 1 is a schematic diagram of a substrate 4 of an experimental device that is used by the inventors to perform the experiment. The substrate 4 is used as a toner carrying member and it includes a glass substrate 1, an electrode pattern 2, and a protective coating 3. Aluminium is vapor-deposited on the glass substrate 1 to form the electrode pattern 2 that includes a plurality of electrodes 21, 22, 23, 24, . . . , 2*n* (where n is a positive integer), that are arranged in a horizontal direction at a pitch of p micrometer (μm). A resin coating having a thickness of approximately 3 μm and a volume resistivity of approximately $1\times10^{10}\Omega\cdot$cm is arranged on the electrode pattern 2 as the protective coating 3. A layer of charged toner 5 is formed on the substrate 4.

Figure 2:
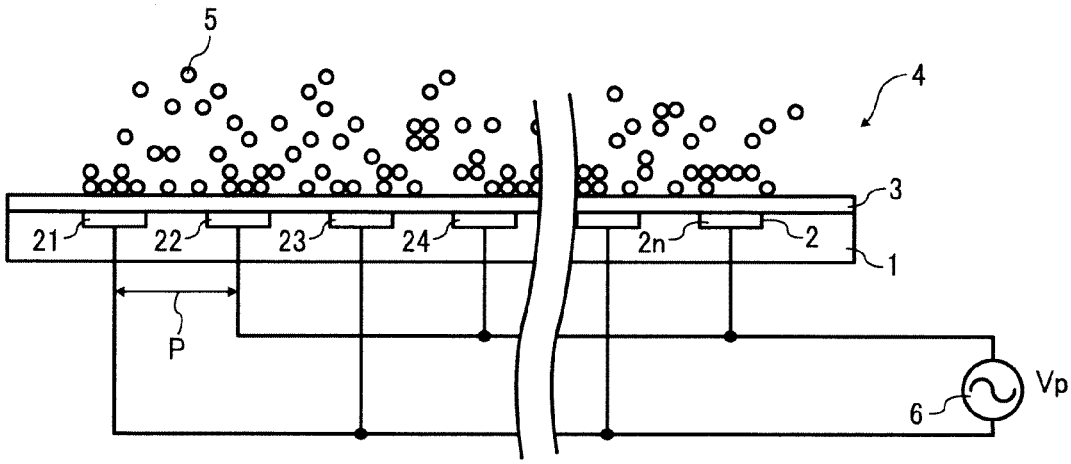
FIG. 2 is a schematic diagram of the substrate that has formed flare on a surface.

The toner layer 5 is formed on the substrate 4 by developing a solid image to a thin layer by using a bicomponent developing unit (not shown). Polyester toner having a granule diameter of approximately 6 μm is used to develop the solid image. As shown in FIG. 2, an AC voltage is applied to odd-numbered electrodes 21, 23, and so on with an alternating current (AC) power source 6. On the other hand, a reverse phase AC voltage compared to the previous AC voltage is applied to even-numbered electrodes 22, 24, and so on with the AC power source 6. Due to this, toner particles in the toner layer 5 repeatedly hop and reciprocate between the odd-numbered electrodes 21, 23, and so on and the even-numbered electrodes 22, 24, and so on. Hereinafter, this phenomenon will be called "flare" or "flare phenomenon" as appropriate. A state that the flare phenomenon is occurring is called "flare state".

After occurrence of the flare, the AC voltage is stopped and a charge on the toner is measured periodically. It is observed that the charge on the toner increased with time and finally reached a saturation value. Thus, it is ascertained that the toner on the surface of the toner carrying member is friction-charged due to hopping, although the charge is negligible, and that the toner in the flare status can be sufficiently friction-charged until transportation to a developing area.

Figure 3:
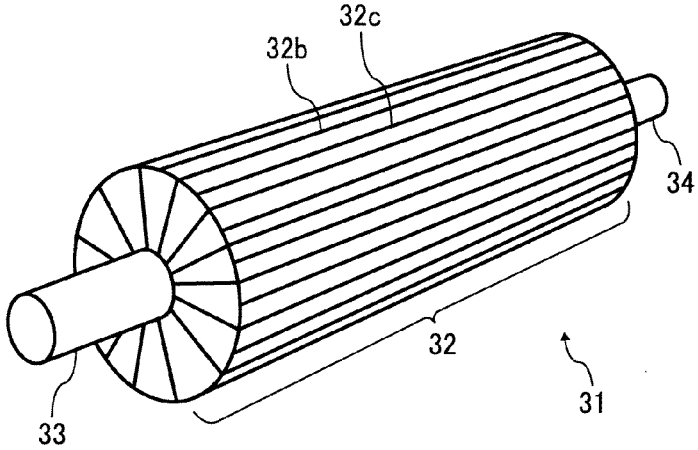
FIG. 3 is a schematic diagram of a toner carrying member of an image forming apparatus according to an embodiment of the present invention.

An image forming apparatus according to an embodiment of the present invention is explained next. FIG. 3 is a schematic diagram of a toner carrying member 31 of the image forming apparatus according to the embodiment. The toner carrying member 31 includes a cylindrical roller 32 and shaft members 33 and 34 that are fixed at both the ends of the roller 32 in a length direction of the roller 32. A plurality of electrodes 32*b* and 32*c*, which extend in the length direction, are arranged at a predetermined pitch in a circumferential direction (a rotational direction) on a circumferential surface of the roller 32. The electrodes are mutually conductive. The electrodes include a plurality of first electrodes 32*b* and a plurality of second electrodes 32*c*. The first electrodes 32*b* are mutually conductive and the second electrodes 32*c* are mutually conductive.

Figure 4:
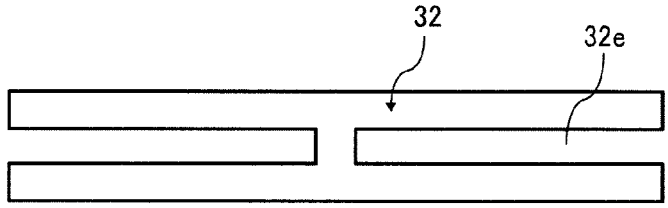
FIG. 4 is a cross-section of a roller of the toner carrying member shown in FIG. 3.

FIG. 4 is a cross-section of the roller 32. The roller 32 is formed of insulating acrylic resin. Shaft holes 32*e*, which extend in the length direction, are formed at both the ends of the roller 32 at its center.

Figure 5:
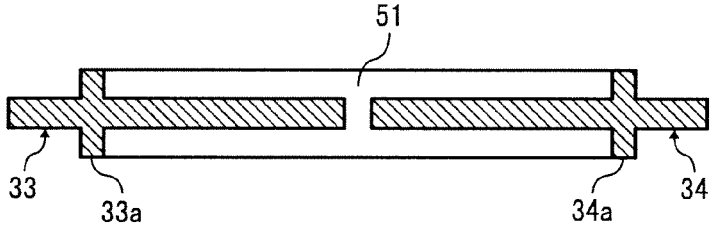
FIG. 5 is another cross-section of the toner carrying member shown in FIG. 3.

FIG. 5 is a cross-section of the toner carrying member 31. The shaft member 33 is press-fitted into the shaft hole 32*e* that is arranged at one end and the shaft member 34 is press-fitted into the shaft hole 32*e* that is arranged at the other end.

Figure 6:
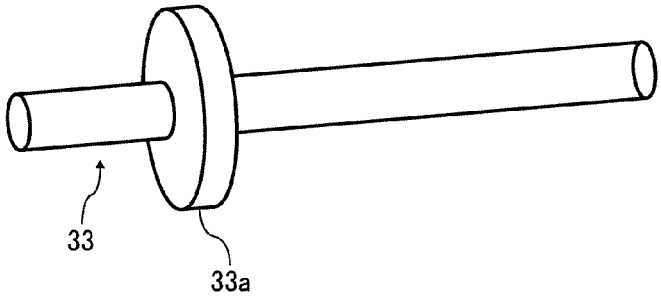
FIG. 6 is a perspective view of a shaft member of the toner carrying member shown in FIG. 3.

FIG. 6 is a perspective view of the shaft member 33. The shaft member 33 is formed of a metallic material such as stainless steel and it includes a circular disk-shaped flange 33*a* fit on a rod-shaped shaft. As shown in FIG. 5, a diameter of the flange 33*a* is the same as the outer diameter of the roller 32. As a result, the flange 33*a* of the shaft member 33 abuts with an end of the roller 32 when the shaft member 33 is press-fitted into the shaft hole 32*e* of the roller 32. In the same manner, although not shown, the flange 34*a* of the shaft member 34 abuts with other end of the roller 32 when the shaft member 34 is press-fitted into the shaft hole 32*e* of the roller 32.

Figure 7:
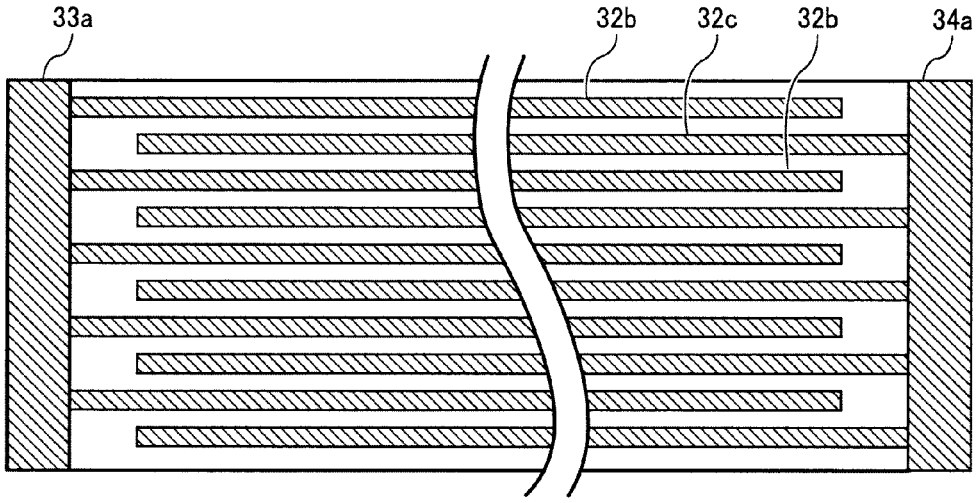
FIG. 7 is an enlarged schematic diagram of a circumferential surface of the toner carrying member shown in FIG. 3.

Therefore, as shown in FIG. 7, the first electrodes 32*b* are conductive with the shaft member 33 via the flange 33*a* and the second electrodes 32*c* are conductive with the shaft member 34 via a flange 34*a*.

The shaft members 33 and 34 that do not include flanges are shown in FIG. 3. When the shaft members 33 and 34 do not include flanges, for example, the first electrodes 32*b* can be extended and connected to the shaft member 33.

Figure 8:
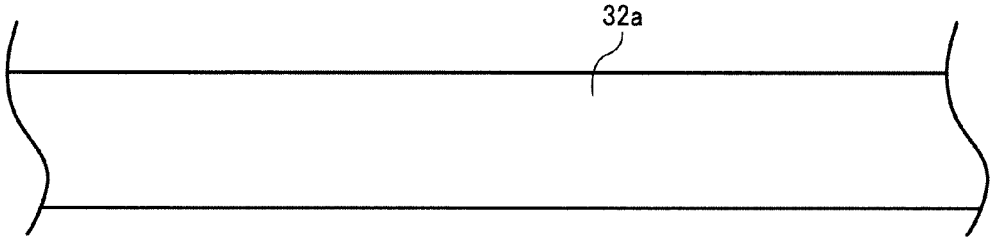
FIGS. 8 to 12 are schematic diagrams for explaining a manufacturing process of the roller shown in FIG. 4.
Figure 9:
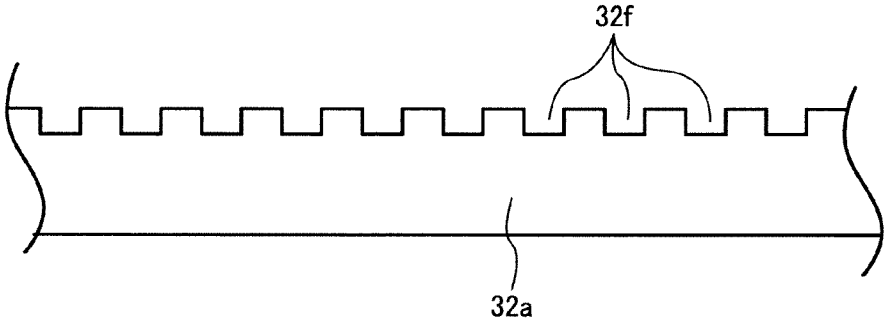
Figure 10:
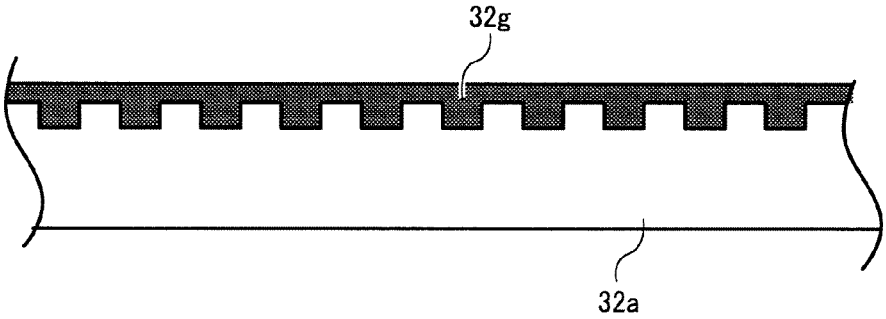
Figure 11:
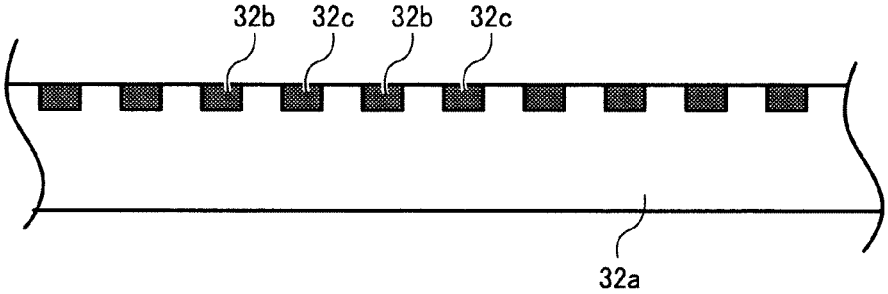
Figure 12:
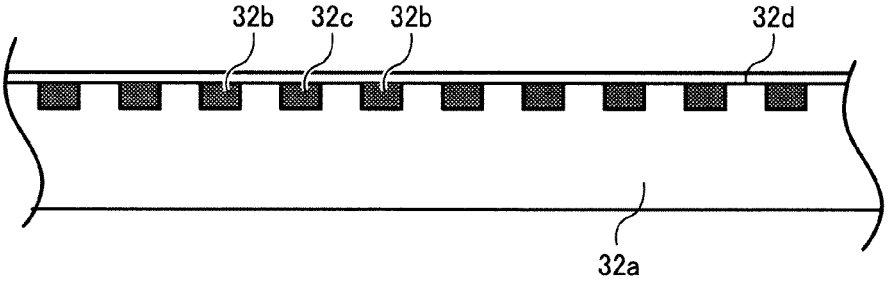

Formation of the roller 32, which includes the first electrodes 32*b* and the second electrodes 32*c*, is explained next while referring to FIGS. 8 to 12. FIGS. 8 to 12 depict cross-sections of the roller 32 along a direction perpendicular to the length direction. The diagrams are not to scale. First, a roller base 32*a* is prepared as shown in FIG. 8. Then, a cutting process is carried out on the surface of a roller base 32*a*, as shown in FIG. 9, thereby forming a plurality of grooves 32*f* at a predetermined pitch on the surface of a roller base 32*a*. The grooves 32*f* extend in the length direction. A width of the grooves 32*f* is approximately 50 μm and the pitch of the grooves 32*f* is approximately 100 μm. Next, as shown in FIG. 10, an electroless nickel depositing process is carried out on the surface of the roller base 32*a* to form a plating layer 32*g*. When forming the plating layer 32*g*, a roller circumferential surface is covered by a plating of a predetermined thickness while causing the plating to reach an inner portion of the respective grooves 32*f*. In the plating layer 32*g* thus formed, portions that have not entered inside the grooves 32*f* are removed using a turning process. Thus, as shown in FIG. 11, the first electrodes 32*b* and the second electrodes 32*c*, which are mutually independent and fit inside the grooves 32*f*, are obtained. Next, as shown in FIG. 12, the surface of the roller base 32*a* is coated with silicon resin, thus forming a surface protective layer 32*d* having a thickness of approximately 5 μm and a volume resistivity of approximately $1\times10^{10}\Omega\cdot$cm.

Figure 13:
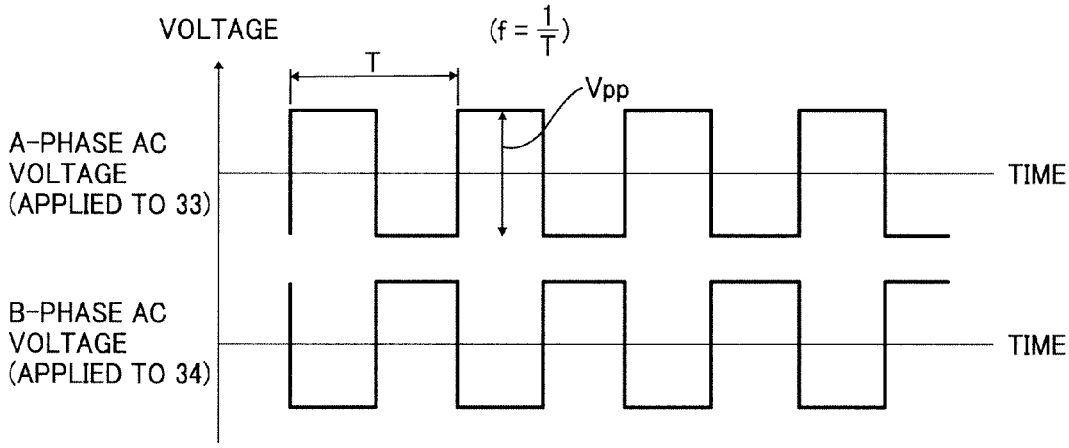
FIG. 13 is a waveform of characteristics of an A-phase alternating current (AC) voltage and a B-phase AC voltage that are applied to electrodes of the roller shown in FIG. 4.

An A-phase AC voltage is applied to the first electrodes 32*b* via the shaft member 33 and a B-phase AC voltage is applied to the second electrodes 32*c* via the shaft member 34. Waveforms of the A-phase AC voltage and the B-phase AC voltage are shown in FIG. 13. As shown in FIG. 13, phases of the A-phase AC voltage and the B-phase AC voltage are mutually reversed and an average electric potential per unit time period is the same for the A-phase AC voltage and the B-phase AC voltage. Upon application of such AC voltage, the toner on the surface of the toner carrying member 31 reciprocates between the first electrodes 32*b* and the second electrodes 32*c* and hops repeatedly, thus forming the flare.

Setting a peak-to-peak voltage (hereinafter, "Vpp") of the A-phase AC voltage and the B-phase AC voltage in a range of 100 V to 1000 V is desirable. If Vpp is less than 100 V, an AC electric field of sufficient strength cannot be formed between the electrodes and suitable hopping of the toner cannot be obtained. Vpp exceeding 1000 V can cause electrical discharge between the electrodes, i.e., between the first electrodes 32*b* and the second electrodes 32*c*. The AC electric field cannot be formed between the electrodes and the toner will not hop if electrical discharge occurs between the electrodes.

Setting a frequency f of the A-phase AC voltage and the B-phase AC voltage in a range of 0.1 kilohertz (kHz) to 10 kHz is desirable. If the frequency f is less than 0.1 kHz, a reciprocating speed of the toner will be slower than that is required for developing. If the frequency f exceeds 10 kHz, hopping of the toner cannot follow a direction switching speed of the AC electric field between the electrodes.

A center value of the A-phase AC voltage and the B-phase AC voltage is set to a value between a latent image electric potential and a background electric potential of a photosensitive drum that is explained later.

In the AC voltage of a rectangular waveform shown in FIG. 13, because a polarity switches instantly, a large electrostatic force can be imparted to the toner. Therefore, an AC voltage having a sine waveform or an AC voltage of a triangular waveform can be used instead of a rectangular waveform.

Figure 14:
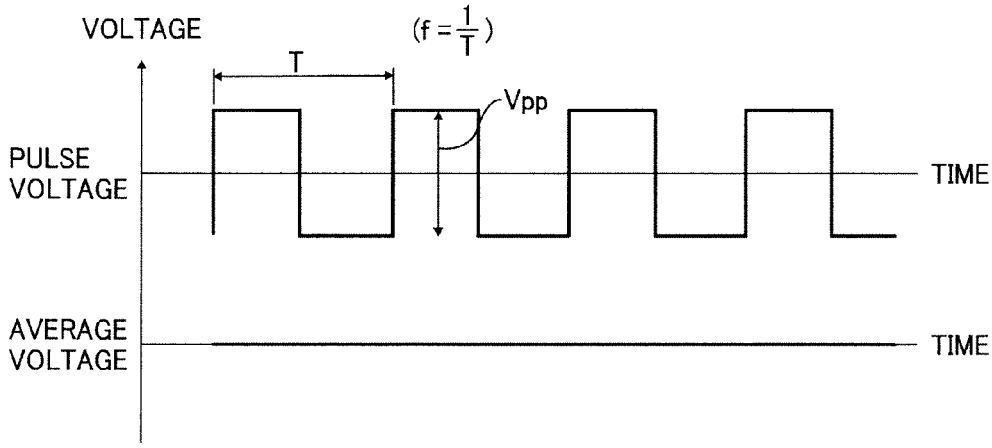
FIG. 14 is a waveform of another example of an electric voltage that is applied to the electrodes of the roller shown in FIG. 4.

As shown in FIG. 14, applying a pulse voltage of the rectangular waveform of the frequency f to one of the shaft members (electrodes) enables to cause occurrence of the flare phenomenon, similar to when using the pulse voltage of a reverse phase, in the other shaft member (electrode) even if a direct current (DC) voltage equivalent to an average electric potential of the pulse voltage is applied to the other shaft member (electrode). During the flare phenomenon, because a maximum electric potential difference between the electrodes becomes half of Vpp, setting Vpp of the pulse voltage between 200 V to 2000 V, in other words, at double the AC voltage, is desirable. Because control such as reversing the phases of two mutually differing AC voltages is not required, cost of a power source can be reduced.

Figure 15:
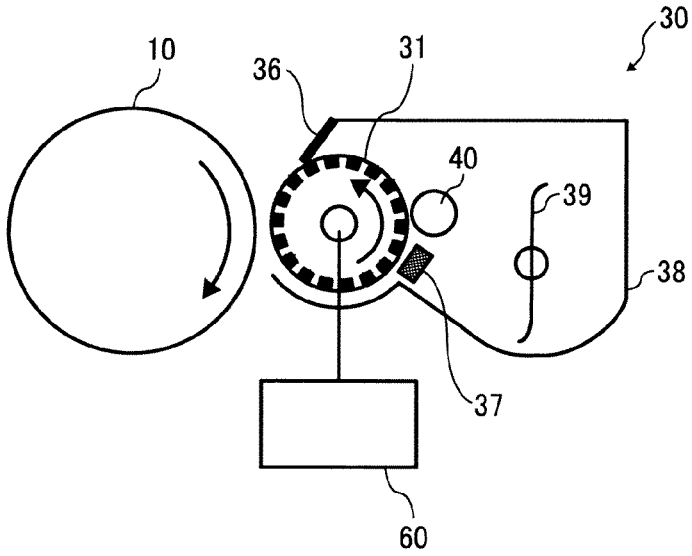
FIG. 15 is a schematic diagram of relevant parts of the image forming apparatus according to the embodiment.

FIG. 15 is a schematic diagram of relevant parts of the image forming apparatus. The image forming apparatus includes a drum-shaped photosensitive drum 10 as a latent-image carrying member and a developing unit 30.

The photosensitive drum 10 is a commonly known general organic photosensitive drum that is rotatably driven in a clockwise direction by a driving unit (not shown). A charger (not shown) uniformly charges a surface of the rotating photosensitive drum 10 at a predetermined rotating position. Next, an optical writing unit (not shown) optically scans the surface of the photosensitive drum 10, thus causing the photosensitive drum 10 to carry an electrostatic latent image.

The photosensitive drum 10 treats as a background portion, an organic photosensitive layer having a thickness of 13 μm that is uniformly charged by the charger to −300 V to −500 V. Next, the optical writing unit optically scans the background portion at a resolution of 120 dots per inch (dpi) to form the electrostatic latent image. An electric potential of the electrostatic latent image is approximately 0 V to −5 V.

The developing unit 30 includes inside a casing 38, a toner housing unit, the toner carrying member 31, a toner recollecting electrode 37, an agitator 39, and a toner-supplying brush roller 40. The toner housing unit houses therein the toner (not shown) that is transported towards the toner-supplying brush roller 40 due to rotatable driving of the agitator 39 that is a rotating member. The toner-supplying brush roller 40 supplies the toner onto the surface of the toner carrying member 31.

The toner carrying member 31 is rotated in a counterclockwise direction by a driving unit (not shown). The toner is supplied onto the surface of the rotatably driven toner carrying member 31 at a position opposite the toner-supplying brush roller 40. Along with rotations of the toner carrying member 31, the supplied toner is transported to the developing area while forming the flare on the surface of the toner carrying member 31 due to repeated hopping. Next, the toner, which has formed the flare in the developing area, adheres to the electrostatic latent image on the photosensitive drum 10 and contributes to developing.

Figure 16:
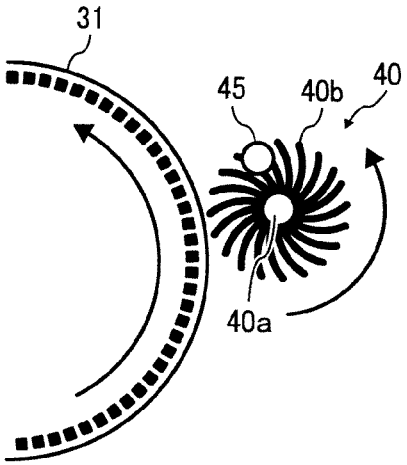
FIGS. 16 to 20 are enlarged schematic diagrams of a portion of the configuration shown in FIG. 15.

FIG. 16 is an enlarged schematic diagram of the toner carrying member 31 and the toner-supplying brush roller 40 shown in FIG. 15. The toner-supplying brush roller 40 includes a rotatably supported rotating shaft member 40*a* formed of metal and a brush that includes a plurality of raisings 40*b* that are erected on a circumferential surface of the rotating shaft member 40*a*. The raisings 40*b* are fibers formed of nylon, rayon, or acrylic having a thickness of 10 deniers to 20 deniers and a length of 1 millimeter (mm) to 15 mm. The raisings 40*b* are transplanted at a density of 1 to 30 (million per square inch). An electrical resistance of the brush is $1\times10^3\Omega\cdot$cm to $1\times10^8\Omega\cdot$cm.

A flicker wire 45, which is a touching member, touches the brush of the toner-supplying brush roller 40 at a predetermined rotation angle position.

As shown in FIG. 16, a toner supplying unit of the image forming apparatus includes the toner-supplying brush roller 40, the flicker wire 45, and a rotatable driving unit of the toner-supplying brush roller 40.

The rotating toner-supplying brush roller 40 traps inside the brush, the toner that is transported from the agitator 39 that is shown in FIG. 15. Although the toner is marginally charged due to stirring by the agitator 39, the charge is still not sufficient. Along with the rotation of the toner-supplying brush roller 40, the brush, which has trapped the toner at the position opposite the agitator 39, enters into a touching position with the flicker wire 45 that is formed of acrylic, nylon, or stainless steel. A portion of the toner, which is trapped inside the brush, touches the flicker wire 45 at the touching position. However, along with touching the flicker wire 45, raising tips of the raisings 40*b* of the brush significantly bend such that the raising tips are positioned towards an upstream side in a brush rotation direction than raising bases. Due to this, the raisings 40*b* are not pressed strongly against the flicker wire 45. Thus, a frictional force, which operates on the toner due to touching with the flicker wire 45, is extremely marginal, and does not charge the toner sufficiently.

When the toner-supplying brush roller 40 rotates further, the raisings 40*b*, which are significantly bent due to touching with the flicker wire 45, are separated from the flicker wire 45. When separating from the flicker wire 45, the significantly bent raisings 40*b* are rapidly extended straight due to strength of the raisings 40*b* themselves, thus carrying out a flicker movement. The toner, which is trapped among the raisings 40*b*, is shaken off from the raisings 40*b* due to the flicker movement and flies from inside the brush. Flying of the toner causes formation of a toner cloud (a floating toner cluster) between the toner-supplying brush roller 40 and the toner carrying member 31. The toner in the toner cloud is pulled by the AC electric field that is formed between the electrodes on the toner carrying member 31, and the toner is transferred onto the surface of the toner carrying member 31, thus forming the flare.

Thus, the toner supplying unit forms the toner cloud at the position opposite the toner carrying member 31, thus supplying the toner to the surface of the toner carrying member 31. In this structure, the toner is supplied to the surface of the toner carrying member 31 without causing the toner to strongly rub against a blade member, without causing a friction between the toner and the magnetic carrier, without causing a friction between the toner and the rotating toner carrying member, or without causing a friction between the toner carrying member 31 and a rotating toner supplying member. Thus, unnecessary stress, which is imparted on the toner that is supplied to the toner carrying member 31, can be reduced.

The flicker wire 45, which is the touching member, is extremely thin and a touching area of the flicker wire 45 with the brush is small. Due to this, a contact frictional force on the toner can be significantly reduced. The toner supplying unit can be easily assembled in a small space inside the casing 38.

A power source (not shown) applies an electric voltage to the brush of the toner-supplying brush roller 40. The electric potential difference between the brush and the toner carrying member 31 (the average electric potential of the AC voltage that is applied to the electrodes of the toner carrying member 31) results in formation of the electric field that causes the toner to electrostatically move from the brush to the toner carrying member 31. The electric field enables to efficiently transfer the toner in the toner cloud onto the surface of the toner carrying member 31.

For applying the electric voltage to the brush of the toner-supplying brush roller 40, a method to apply the electric voltage via the rotating shaft member 40*a* or a method to apply the electric voltage via the flicker wire 45 can be used.

Only the DC voltage having the same polarity as the polarity of the toner can be applied as the electric voltage to the brush. Alternatively, a DC/AC superimposed voltage, which includes the AC voltage superimposed on the DC voltage, can also be applied to the brush. When using the DC/AC superimposed voltage, an adhesive force of the raisings 40*b* and the toner weakens due to an operation of the AC electric field and clouding of the toner due to the flicker movement of the raisings 40*b* can be fostered.

As shown in FIG. 15, the casing 38 of the developing unit 30 includes an opening for exposing and positioning directly opposite the photosensitive drum 10, a portion of the circumferential surface of the toner carrying member 31. A minute gap is formed between an inner wall of the opening and the toner carrying member 31. The toner cloud inside the casing 38 is likely to fly outside the casing 38 via the minute gap. As shown in FIG. 15, a sealing member 36 is arranged in the developing unit 30 as a flying preventing member for preventing the toner from flying via the minute gap. The sealing member 36, which is extremely flexible, is cantileverly supported by the casing 38 in the vicinity of the opening of the casing 38. The sealing member 36 softly touches the surface of the toner carrying member 31 using a free end of the sealing member 36 itself. Even if the toner passes between the toner carrying member 31 and the free end of the sealing member 36, because the sealing member 36 causes the free end side to bend flexibly, the stress imparted by the sealing member 36 on the toner is negligible. The toner, not included in the toner cloud, which has formed the flare on the surface of the toner carrying member 31, is pulled by the AC electric field between the electrodes and rotates along with the toner carrying member 31. Due to this, the toner can easily pass between the toner carrying member 31 and the sealing member 36. However, even while forming the flare, the toner having insufficient charge amount cannot be sufficiently pulled by the AC electric field between the electrodes and a passage between the toner carrying member 31 and the sealing member 36 is blocked. Due to this, only the sufficiently charged toner can be transported to the developing area.

In the image forming apparatus according to the embodiment, a base material resin (a main component of the toner), which is used as the toner, is formed of polyester or styrene acrylic and has a minus polarity (negative polarity) as normal charge polarity. Both the background portion of the photosensitive drum 10 and the electrostatic latent image are of the same polarity as the normal charge polarity of the toner (negative polarity in the embodiment) and the toner is caused to selectively adhere to the electrostatic latent image having the electric potential that is attenuated than the electric potential of the background portion. Such a method is called reverse developing.

As shown in FIG. 12, the toner carrying member 31 includes the surface protective layer 32*d*. A material, which is used as the surface protective layer 32*d*, promotes friction charging of a normal charge polarity side (negative side in the embodiment) of the toner along with friction with the toner. In other words, the toner is positioned on the negative side on a friction-charging sequence than the surface protective layer 32*d*. Organic materials such as silicon, nylon, melanin resin, acrylic resin, polyvinyl alcohol (PVA), urethane etc. can be used as the material of the surface protective layer 32*d* that enables to realize the relation mentioned earlier. Quaternary ammonium salts or nixilon type dyes can also be used. A material, which includes a mixture of two or more materials mentioned earlier, can also be used.

The toner, which repeatedly collides with the surface protective layer 32*d* due to hopping, is sufficiently friction-charged until being transported towards the developing area.

A material having a plus polarity (positive polarity) as the normal charge polarity can also be used as the toner. When using the toner of a positive polarity, a material, which promotes friction charging of a positive polarity side of the toner along with friction with the toner, can be used as the protective coating 3.

A charging sequence of the toner indicates a charging sequence of the entire toner that includes an external additive such as silica, titanium oxide etc. added to a toner base material resin (granules). A hierarchy in the charging sequence can be investigated using the following method. In other words, the toner is caused to rub against the surface protective layer 32*d* for a predetermined time period, and the toner is collected by sucking. Next, the charge amount of the collected toner is measured using an electrometer. Based on a measurement result, if the charge on the toner has increased to the negative polarity, the measurement result indicates that the toner is positioned at a negative side than the surface protective layer 32*d* in the charging sequence. If the charge on the toner has increased to the positive polarity, the measurement result indicates that the toner is positioned at a positive side in the charging sequence.

An intermediate layer can also be arranged between the surface protective layer 32*d* and the electrodes. The intermediate layer can be formed of a conductive material such as titanium (Ti), tin (Sn), iron (Fe), copper (Cu), chromium (Cr), nickel (Ni), zinc (Zn), magnesium (Mg), aluminium (Al), titanium oxide ($TiO_2$), tin oxide ($SnO_2$), ferric oxide ($Fe_2O_3$), magnetite ($Fe_3O_4$), cuprous oxide (CuO), chromium oxide ($Cr_2O_3$), nickel oxide (NiO), zinc oxide (ZnO), magnesium oxide (MgO), aluminium oxide ($Al_2O_3$) etc.

As shown in FIG. 15, toner that does not contribute to developing in the developing area, is carried onto the surface of the toner carrying member 31 while forming the flare and returns to inside the casing 38. The toner enters an area opposite the toner recollecting electrode 37.

A recollecting unit recollects the toner that has not contributed to developing from the surface of the toner carrying member 31. The recollecting unit includes the toner recollecting electrode 37 shown in FIG. 15 and a recollecting power source (not shown) that applies a recollection voltage to the toner recollecting electrode 37. The toner in the flare, which has entered the area opposite the toner recollecting electrode 37 along with the rotations of the toner carrying member 31, is transferred to the toner recollecting electrode 37 due to the electric potential difference between the toner carrying member 31 (the average value of the AC voltage that is applied to the electrodes of the toner carrying member 31) and the toner recollecting electrode 37. Thus, the toner, which has not contributed to developing, is recollected from the surface of the toner carrying member 31.

The toner can be mechanically scraped and collected from the surface of the toner carrying member 31 by pressing a recollecting member, such as a blade, against the toner carrying member 31 or by using a flicker member to cause raisings of a rotating fur brush to touch the toner carrying member 31 while carrying out the flicker movement. However, mechanical scraping imparts unnecessary stress on the toner. In the image forming apparatus according to the embodiment, the toner is recollected without causing the recollecting member to rub against the toner that is being subjected to the flare. Thus, the toner can be recollected without imparting unnecessary stress due to rubbing.

A toner image, which is developed on the photosensitive drum 10, is transferred by a transferring unit (not shown) to a recording sheet that is a transfer member.

Figure 17:
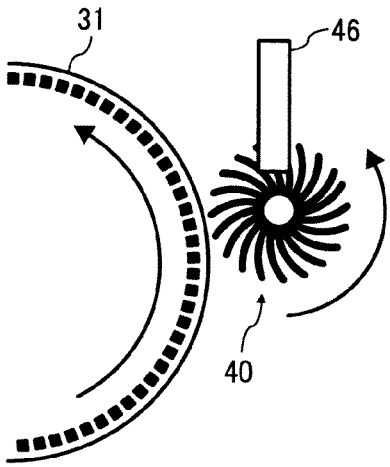

FIG. 17 is an enlarged schematic diagram of the toner carrying member 31 and the toner-supplying brush roller 40 in a first modification of the developing unit 30 according to the embodiment. In the first modification, a plate-shaped flicker plate 46 is used as the touching member that touches the brush of the toner-supplying brush roller 40. The flicker plate 46 is cantileverly supported by a supporting unit (not shown) and a free end side of the flicker plate 46 touches the brush. Because the flicker plate 46 is stronger compared to the flicker wire 45, the flicker plate 46 can cause the raisings 40*b* to carry out the flicker movement for a longer period without getting damaged. In addition, the flicker plate 46 can be imposed more easily than the flicker wire 45.

Figure 18:
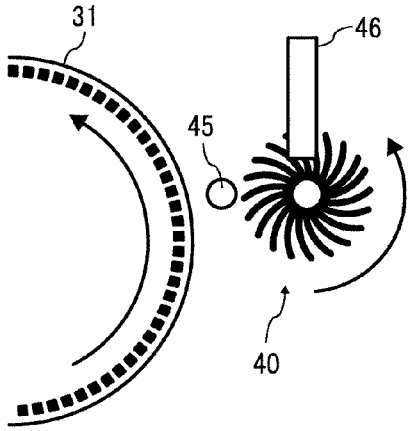

FIG. 18 is an enlarged schematic diagram of the toner carrying member 31 and the toner-supplying brush roller 40 in a second modification of the developing unit 30 according to the embodiment. In the second modification, both the wire-shaped flicker wire 45 and the plate-shaped flicker plate 46 are used as the touching members that touch the brush of the toner-supplying brush roller 40. After the brush has entered a toner trapping position along with rotations of the toner-supplying brush roller 40, the flicker plate 46 touches the brush at an upstream side in a roller rotational direction compared to the flicker wire 45 in an area before the brush has entered a position opposite the toner carrying member 31. A relation between the upstream side and a downstream side of the flicker plate 46 and the flicker wire 45 can also be reversed. The DC voltage of the same polarity as the polarity of the toner is applied to the touching member that is arranged on the upstream side (the flicker plate 46 in the example shown in FIG. 18), thus causing the touching member to include a function to charge the toner inside the brush using charge injection. The DC/AC superimposed voltage, which includes the AC voltage that is superimposed on the DC voltage of the same polarity as the polarity of the toner, is applied to the touching member that is arranged on the downstream side (the flicker wire 45 in the example shown in FIG. 18). Due to this, while forming an electric field that causes the toner cloud to move from the brush to the toner carrying member 31, the adhesive force between the toner and the raisings is weakened due to the AC electric field, thus fostering clouding of the toner. Arranging a toner detector such as an optical sensor, which detects an amount of toner on the surface of the toner carrying member 31, enables to change the values of the DC voltage and the AC voltage of the DC/AC superimposed voltage according to the toner amount, thus enabling to control a toner supply amount according to the toner amount.

Figure 19:
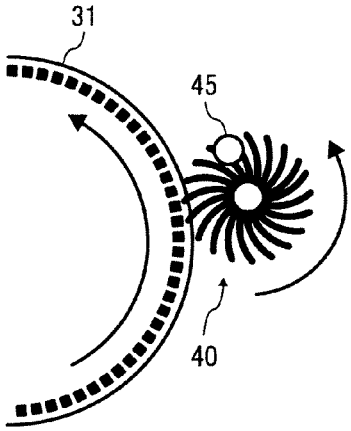

FIG. 19 is an enlarged schematic diagram of the toner carrying member 31 and the toner-supplying brush roller 40 in a third modification of the developing unit 30 according to the embodiment. In the third modification, the toner-supplying brush roller 40 touches the toner carrying member 31. Compared to a structure in which a toner-supplying sponge roller is caused to touch the toner carrying member 31, the brush of the toner-supplying brush roller 40 flexibly bends at a touching portion with the toner carrying member 31. Due to this, stress on the toner at the touching portion can be significantly reduced. Although stress cannot be completely eliminated, the toner, which has not contributed to developing on the toner carrying member 31, can be recollected by the toner-supplying brush roller 40 at the touching portion of the toner carrying member 31 and the toner-supplying brush roller 40 even if the toner recollecting electrode 37 is not arranged. In other words, causing the toner-supplying brush roller 40 to function as the recollecting unit enables to reduce costs.

Figure 20:
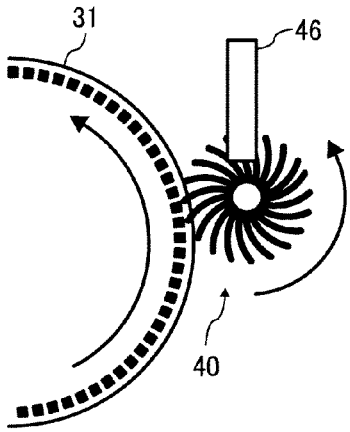

FIG. 20 is an enlarged schematic diagram of the toner carrying member 31 and the toner-supplying brush roller 40 in a fourth modification of the developing unit 30 according to the embodiment. In the fourth modification, in the configuration of the first modification, the toner-supplying brush roller 40 touches the toner carrying member 31. Thus, similarly as in the third modification, causing the toner-supplying brush roller 40 to function as the recollecting unit enables to reduce costs.

Figure 21:
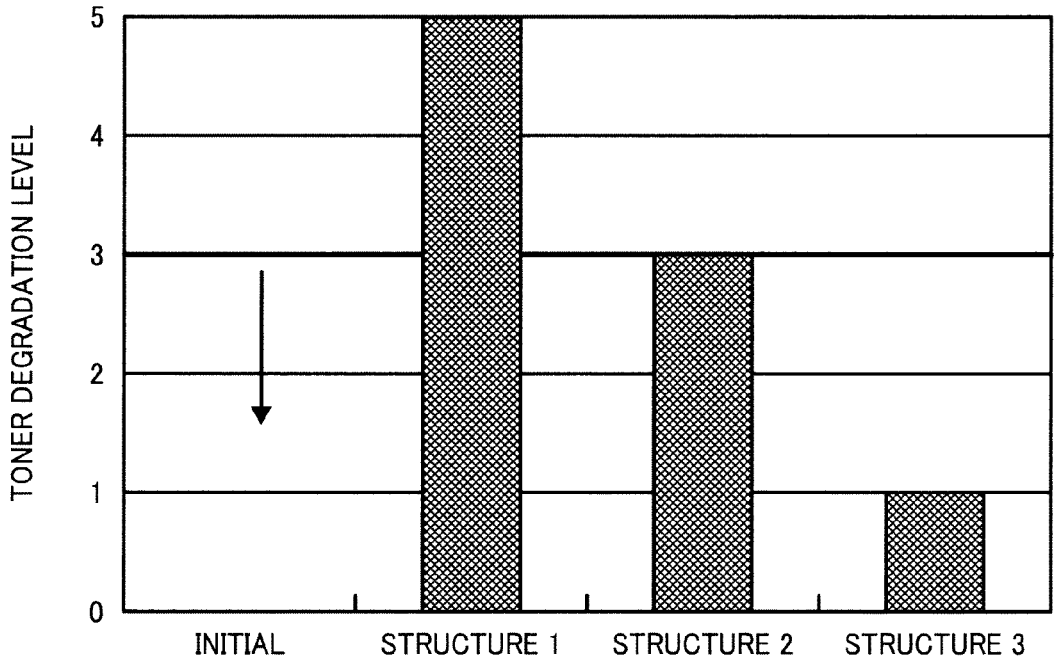
FIG. 21 is a graph of a relation between a structure of the developing unit and a toner degradation level at the time of toner supply.

FIG. 21 is a graph of a relation between a structure of the developing unit 30 and a toner degradation level at the time of toner supply. "Structure 1" shown in FIG. 21 indicates a structure in which a sponge roller is used instead of the toner-supplying brush roller 40 in the developing unit 30 shown in FIG. 3, and the sponge roller is caused to rotate while touching the surface of the toner carrying member 31. Moreover, a blade member touches the sponge roller and strongly scrapes the toner on the surface of the sponge roller, thus friction-charging the toner. "Structure 3" indicates a structure similar to the structure in the third and the fourth modifications in which the toner-supplying brush roller 40 touches the toner carrying member 31. "Structure 2" indicates a structure similar to the structure in the developing unit 30 according to the embodiment and the first modification in which the toner-supplying brush roller 40 is non-touchably arranged with respect to the toner carrying member 31. The toner recollecting electrode 37 is also non-touchably arranged with respect to the toner carrying member 31. "Toner degradation level" is an index value that indicates a degradation status of a toner surface. In the toner having the toner degradation level of "4" or "5", the external additive of a granule surface is buried or detached due to repeatedly receiving stress and a parent granule is completely exposed. The charge on such toner becomes abnormal and the toner cannot form the flare. For evaluating "toner degradation level", the developing unit 30 was driven for a certain time without carrying out development of the latent image and the toner recollected from inside the developing unit 30 was observed. During the evaluation, the toner degradation level of the toner in an initial status is treated as "0".

For Structure 1, the toner degradation level is "5". However, for Structure 2, the toner degradation level is low, i.e., "3", that is within a desirable range. Thus, supplying the toner, which is subjected to clouding due to the flicker movement of the toner-supplying brush roller 40 to the toner carrying member 31, enables to significantly reduce degradation of the toner. For Structure 3, the toner degradation level is still low, i.e., "1", thus indicating further improvement. Unlike Structure 2, because Structure 3 does not cause friction of the toner due to rubbing of the toner-supplying brush roller 40 and the toner carrying member 31, degradation of the toner is further reduced.

The developing unit 30 according to the embodiment and the modifications explained earlier is housed in a common housing along with the photosensitive drum 10 and functions as a single processing unit that is attached to or detached from a main body of the image forming apparatus.

In the embodiment of the image forming apparatus explained earlier, the flare phenomenon is obtained by causing the toner to hop such that the toner reciprocates between two adjacent electrodes, and the toner is transported to the developing area by the surface movement of the toner carrying member. However, the present invention can also be applied to the following image forming apparatus. In other words, similarly as the method disclosed in Japanese Patent Application Laid-open No. 2007-133389, the image forming apparatus causes the toner to repeatedly hop from one electrode towards the other adjacent electrode in a direction from one end side towards the other end side of the toner carrying member, thus transporting the toner towards the developing area. The present invention can also be applied to an image forming apparatus that transports the toner towards the developing area by using both the movement of the toner due to hopping and the surface movement of the toner carrying member.

The developing unit 30 uses as a brush member, the rotatable toner-supplying brush roller 40 that includes the rotating shaft member 40*a* and the brush that includes the raisings 40*b* that are erected on the circumferential surface of the rotating shaft member 40*a*. The developing unit 30 includes the toner supplying unit that includes the flicker wire 45 as the touching member that touches the brush of the rotating toner-supplying brush roller 40 at a predetermined rotation position and causes the raisings 40*b* of the brush to carry out the flicker movement. Due to the structure mentioned earlier, the raisings 40*b*, which have moved to the predetermined rotation position, can be subjected to the flicker movement by simply rotatably driving the toner-supplying brush roller 40.

In the developing unit 30 according to the embodiment, the wire-shaped flicker wire 45 is used as the touching member. In the structure mentioned earlier, because the touching area of the flicker wire 45 and the brush is less, the contact frictional force on the toner can be significantly reduced. The toner supplying unit can be easily assembled in a small space inside the casing 38.

In the developing unit 30 according to the first modification, the plate-shaped flicker plate 46 is used as the touching member. Due to this, compared to the flicker wire 45, the flicker plate 46 can cause the raisings 40*b* to carry out the flicker movement for a longer time without getting damaged. The flicker plate 46 can be imposed more easily than the flicker wire 45.

In the developing unit 30 according to the second modification, both the wire-shaped flicker wire 45 and the plate-shaped flicker plate 46 are used as the touching members. Using the structure mentioned earlier enables to apply the DC voltage having the same polarity as the polarity of the toner to any one of the touching members, among the flicker wire 45 and the flicker plate 46, thus causing the touching member to include a function to charge the toner inside the brush using charge injection, and enables the other touching member to include a function to form the electric field that causes the toner cloud to move from the brush side to the toner carrying member 31 side and to cause the other touching member to weaken the adhesive force between the toner and the raisings 40*b* using the AC electric field, thus fostering clouding of the toner.

In the developing unit 30 according to the embodiment and the first and the second modifications, the toner-supplying brush roller 40 is arranged at a non-touching position with respect to the toner carrying member 31. Due to this, compared to a structure in which the toner-supplying brush roller 40 touches the toner carrying member 31, the stress on the toner at the time of supply can be reduced.

In the developing unit 30 according to the embodiment and various modifications, a voltage applying unit is included that applies the electric voltage to the brush of the toner-supplying brush roller 40. The structure mentioned earlier enables to form between the brush and the toner carrying member 31, using the electric potential difference between the brush and the toner carrying member 31, the electric field that causes the toner to electrostatically move from the brush to the toner carrying member 31. Thus, the toner in the toner cloud can be efficiently transferred onto the surface of the toner carrying member 31.

In the developing unit 30 according to the embodiment and the first and the second modifications, the recollecting unit is included that recollects from the surface of the toner carrying member 31, the toner that has passed the developing area. Thus, the structure mentioned earlier enables to avoid destabilization of the toner amount on the surface of the toner carrying member 31 that occurs due to return of the toner to a toner supply position.

In the developing unit 30 according to the embodiment and the first and the second modifications, the recollecting unit that is used includes the toner recollecting electrode 37 that is an opposite electrode member positioned opposite the surface of the toner carrying member 31 and a recollection-electric-potential-difference causing unit that causes the electric potential difference for toner recollection between the surface of the toner carrying member 31 and the toner recollecting electrode 37. The structure mentioned earlier enables to recollect the toner without causing a toner recollecting member to touch the toner carrying member 31, thus enabling to avoid imparting of stress on the toner at a touching portion.

In the developing unit 30 according to the third and the fourth modifications, the toner-supplying brush roller 40 is arranged at a touching position with respect to the toner carrying member 31. Due to this, the toner-supplying brush roller 40 can also be used as the recollecting unit and a cost of the developing unit 30 can be reduced.

In the developing unit 30 according to the embodiment and various modifications, the casing 38 includes the opening for exposing a portion of the surface of the toner carrying member 31 towards the photosensitive drum 10. The casing 38 further includes the sealing member 36 that is the fly preventing member for preventing the toner from flying from inside the casing 38 to outside the casing 38 via the gap between the toner carrying member 31 and the opening. The structure mentioned earlier enables to prevent the toner, which is shaken from the toner-supplying brush roller 40 and clouded, from flying outside the casing 38 via the gap.

According to an aspect of the present invention, toner, which is shaken from inside a brush due to a flicker movement of raisings, is caused to float in the vicinity of a surface of a toner carrying member. Thus, the toner is supplied to the surface of the toner carrying member without causing the toner to strongly rub against a blade member, without causing a friction between the toner and a magnetic carrier, without causing a friction between the toner and the rotating toner carrying member, or without causing a friction between the toner carrying member and a rotating toner supplying member. Thus, unnecessary stress, which is imparted on the toner that is supplied to the toner carrying member, can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing unit that transports toner for supplying the toner onto a surface of a toner carrying member by a toner supplying unit, while causing the toner to hop on the surface of the toner carrying member using an electric field, to a developing area that is an area opposite the toner carrying member and a latent-image carrying member, that causes the hopped toner to adhere to a latent image on the latent-image carrying member in the developing area, and that develops the latent image, the developing unit comprising:

a brush member that includes a base member, a plurality of raisings that are erected on a surface of the base member, and a touching member, wherein the brush member traps toner within the raisings and the touching member causes a flicker movement in the raisings of the brush member so that the toner trapped within the raisings is shaken and flown due to the flicker movement to the surface of the toner carrying member, the touching member disposed above the rotational axis of the toner carrying member with respect to the ground.

2. The developing unit according to claim 1, wherein the brush member is held rotatably on a shaft member and the touching member is substantially parallel to the shaft member and touches the raisings of the brush member at a predetermined rotation position.

3. The developing unit according to claim 2, wherein the touching member includes a wire-shaped member.

4. The developing unit according to claim 2, wherein the touching member includes a plate-shaped member.

5. The developing unit according to claim 2, wherein the touching member includes a wire-shaped member and a plate-shaped member.

6. The developing unit according to claim 1, wherein the brush member is arranged at a non-touching position with respect to the toner carrying member.

7. The developing unit according to claim 1, further comprising a voltage applying unit that applies an electric voltage to the brush member.

8. The developing unit according to claim 1, further comprising a recollecting unit that recollects toner that has passed the developing area from the surface of the toner carrying member.

9. The developing unit according to claim 8, wherein the recollecting unit includes:

an opposite electrode member that is positioned opposite the surface of the toner carrying member; and a recollection-electric-potential-difference causing unit that causes an electric potential difference between the surface of the toner carrying member and the opposite electrode member so that toner is attracted toward the opposite electrode member.

10. The developing unit according to claim 1, wherein the brush member is arranged so as to make physical contact with the toner carrying member.

11. The developing unit according to claim 1, further comprising a casing that houses therein the toner carrying member, the toner supplying unit, and the brush member, the casing including an opening located between the toner carrying member towards the latent-image carrying member; and a flying preventing member that prevents toner from flying from inside the casing to outside the casing via a gap between the toner carrying member and the opening.

12. An image forming apparatus that includes:

a latent-image carrying member that carries a latent image;

a charger that charges the latent-image carrying member;

a developing unit that develops the latent image on the latent-image carrying member, wherein the latent-image carrying member is housed, along with the developing unit, in a common housing as a single unit and can be integrally attached to or detached from a main body of the image forming apparatus, and the developing unit transports toner for supplying the toner onto a surface of a toner carrying member by a toner supplying unit, while causing the toner to hop on the surface of the toner carrying member using an electric field, to a developing area that is an area opposite the toner carrying member and the latent-image carrying member, causes the hopped toner to adhere to a latent image on the latent-image carrying member in the developing area, and develops the latent image, the developing unit including:

a brush member that includes a base member, a plurality of raisings that are erected on a surface of the base member, and a touching member, wherein the brush member traps toner within the raisings and the touching member causes a flicker movement in the raisings of the brush member so that the toner trapped within the raisings is shaken and flown due to the flicker movement to the surface of the toner carrying member, the touching member disposed above the rotational axis of the toner carrying member with respect to the ground.

13. An image forming apparatus comprising:

a latent-image carrying member that carries a latent image; and a developing unit that transports toner for supplying the toner onto a surface of a toner carrying member by a toner supplying unit, while causing the toner to hop on the surface of the toner carrying member using an electric field, to a developing area that is an area opposite the toner carrying member and the latent-image carrying member, causes the hopped toner to adhere to a latent image on the latent-image carrying member in the developing area, and develops the latent image, the developing unit including a brush member that includes a base member, a plurality of raisings that are erected on a surface of the base member, and a touching member, wherein the brush member traps toner within the raisings and the touching member causes a flicker movement in the raisings of the brush member so that the toner trapped within the raisings is shaken and flown due to the flicker movement to the surface of the toner carrying member, the touching member disposed above the rotational axis of the toner carrying member with respect to the ground.

14. The developing unit according to claim 13, wherein the flicker movement of the raisings of the brush member creates a toner cloud, which moves toward the toner carrying member.

* * * * *